US007470877B2

(12) United States Patent
Braunisch et al.

(10) Patent No.: US 7,470,877 B2
(45) Date of Patent: Dec. 30, 2008

(54) MICROWAVE OVEN AND VENTILATION HOOD COMBINATION SYSTEM

(75) Inventors: Eckart Braunisch, Kimstad (SE); Andrew D. Litch, St. Joseph, MI (US); Fredrick Hallgren, Kolmarden (SE); Hakan Carlsson, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/683,610

(22) Filed: Mar. 8, 2007

(65) Prior Publication Data

US 2008/0217329 A1 Sep. 11, 2008

(51) Int. Cl.
*H05B 6/80* (2006.01)

(52) U.S. Cl. ..... 219/757; 219/681; 126/299 D

(58) Field of Classification Search ..... 219/757, 219/681, 756, 400; 126/21 A, 299 R, 299 D
See application file for complete search history.

(56) References Cited

U.S. PATENT DOCUMENTS

| | | | | |
|---|---|---|---|---|
| 3,031,946 | A | 5/1962 | Watt et al. | |
| 3,249,037 | A | 5/1966 | Stalker | |
| 3,356,008 | A | 12/1967 | Simpson et al. | |
| 3,496,704 | A | 2/1970 | Bandlow | |
| RE27,225 | E | 11/1971 | Stalker | |
| 4,143,646 | A | 3/1979 | Sampsel | |
| 4,313,043 | A * | 1/1982 | White et al. | 219/757 |
| 4,327,274 | A | 4/1982 | White et al. | |
| 4,332,993 | A * | 6/1982 | Shibahara et al. | 219/757 |
| 4,418,261 | A | 11/1983 | Jailor et al. | |
| 4,956,531 | A * | 9/1990 | Braunisch et al. | 219/757 |
| 4,959,531 | A | 9/1990 | Marino | |
| 5,042,458 | A | 8/1991 | Spencer et al. | |
| 5,941,235 | A | 8/1999 | Carter | |
| 5,981,929 | A | 11/1999 | Maeda et al. | |
| 6,218,654 | B1 | 4/2001 | Braunisch | |
| 6,239,419 | B1 | 5/2001 | Kim | |
| 6,686,576 | B1 | 2/2004 | Yang | |
| 6,717,123 | B1 | 4/2004 | Kim | |
| 6,720,543 | B2 | 4/2004 | Yang | |
| 6,765,184 | B2 | 7/2004 | Yang | |
| 6,768,090 | B2 | 7/2004 | Kang | |
| 6,797,930 | B2 | 9/2004 | Kim | |
| 6,818,874 | B2 | 11/2004 | Jeong | |
| 6,974,936 | B2 | 12/2005 | Yamauchi et al. | |
| 6,992,273 | B2 | 1/2006 | Yim et al. | |
| 2005/0092745 | A1 | 5/2005 | Yim et al. | |

FOREIGN PATENT DOCUMENTS

| | | | | |
|---|---|---|---|---|
| DE | 37 36 745 | * | 5/1989 | 126/38 |

* cited by examiner

*Primary Examiner*—Philip H Leung
(74) *Attorney, Agent, or Firm*—John Morrison; Michael D. LaFrenz

(57) ABSTRACT

A modular microwave oven and ventilation hood combination system, includes a core module, having a core module housing, and a microwave cooking chamber, fitted in the core module housing. The system further includes an intake module, having an intake module housing connected to a lower side of the core module housing, and an air inlet for drawing air from an area above a range.

25 Claims, 4 Drawing Sheets

MICROWAVE OVEN AND VENTILATION HOOD COMBINATION SYSTEM

BACKGROUND OF THE INVENTION

1. Field of the Invention

The present disclosure relates to a modular microwave oven and ventilation hood combination system.

2. Description of the Related Art

Combined microwave ovens and ventilation hoods adapted for mounting above a kitchen range are known from e.g. the documents referred to below. Such devices will hereinafter be referred to as "combination systems".

U.S. Pat. No. 4,143,646 discloses a combined microwave oven and ventilation hood, wherein the ventilation hood is arranged above the microwave oven. An first air intake is arranged below the microwave oven and connected to the ventilation hood by a vertical duct behind the oven. A second air intake is arranged above the oven. The ventilation hood may selectively be connected to an exhaust duct or arranged to provide air recirculation. This combination system has a fixed configuration, and thus cannot be varied to suit different installation environments. Furthermore, the arrangement of the fan unit visibly on top of the microwave oven is bulky and may be undesirable in some instances.

U.S. Pat. No. 4,327,274 discloses a combined microwave oven and ventilation hood, wherein an air intake and fan unit is placed below the microwave oven and is arranged to conduct air to an exhaust duct. A separate microwave oven cooling system is provided for circulating air to cool the components of the microwave oven. This combination system has a fixed configuration, and can only be installed where there is an exhaust duct available, since it does not enable air recirculation.

U.S. Pat. No. 4,418,261 discloses a combined microwave oven and ventilator system, wherein the microwave oven is arranged in a chassis having air channels from its lower side to its upper side, and wherein a ventilation system including a fan is arranged on the upper side. Controls for the ventilation unit are arranged on the louvered facing panel surrounding the microwave oven. This combination system is a fixed configuration and can only be used where there is a cabinet above the intended position of the appliance, since the fan unit is positioned above the microwave oven. Furthermore, this combination system can only be installed where there is an exhaust duct available, since it does not enable air recirculation.

U.S. Pat. No. 5,042,458 discloses a combined microwave oven and ventilator system, wherein the ventilator unit is arranged on top of the microwave oven and wherein there are ventilation channels provided from a lower side of the microwave oven to the upper side thereof. This combination system has a fixed configuration. Furthermore, the arrangement of the fan unit visibly on top of the microwave oven is bulky and may be undesirable in some instances.

U.S. Pat. No. 6,218,654 B1 discloses a combined microwave oven and ventilator system, wherein the ventilator unit is arranged on top of the microwave oven, and wherein there are ventilation channels provided from a lower side of the microwave oven to the upper side thereof. This combination system has a fixed configuration. Furthermore, the arrangement of the fan unit visibly on top of the microwave oven is bulky and may be undesirable in some instances.

U.S. Pat. No. 6,768,090 B2 discloses a combined microwave and ventilator system, wherein the ventilator unit is arranged on top of the microwave oven, and wherein there are ventilation channels provided from a lower side of the microwave oven to the upper side thereof. This combination system has a fixed configuration. Furthermore, the arrangement of the fan unit visibly on top of the microwave oven is bulky and may be undesirable in some instances.

Designers of combination systems are faced with particular challenges, since they have to combine oven functionality and ventilation functionality in a very limited space. For example, the microwave part of the combination system must be of a certain general size in order to fit over the range at required heights and to fit between and relatively flush with kitchen cabinets. Furthermore, the parts within the combination system compete for space.

At the same time, the hood part should provide a sufficient airflow (often referred to as CFM—Cubic Feet per Minute) and an acceptably low noise.

Another challenge is to enable cost effective production and maintenance of the combination systems.

Hence, there is a need for an improved or alternative combination system, which eliminates or at least alleviates the disadvantages of prior art combination systems.

It is thus a general objective to provide an improved or alternative microwave oven and ventilation hood combination system.

Another objective is to provide a microwave oven and ventilation hood combination system, which is installable in as many different environments as possible.

Yet another objective is to provide a microwave oven and ventilation hood combination system, which an optimal trade off between functionality, space utilization, noise level and airflow.

Yet another objective is to provide a microwave oven and ventilation hood combination system, which can be cost effectively produced.

Yet another objective is to provide a microwave oven and ventilation hood combination system, which is easy to install and maintain.

SUMMARY OF THE INVENTION

Hence, to address at least some of the above objectives, the present disclosure provides a modular microwave oven and ventilation hood combination system. The system includes a core module, comprising a core module housing, and a microwave cooking chamber, fitted in said core module housing. The system further includes an intake module, comprising an intake module housing connected to a lower side of the core module housing, and an air inlet for drawing air from an area above a range.

According to another aspect of the invention, a method is presented for providing a modular microwave oven and ventilation hood combination system. The method comprises the steps of providing a core module, comprising a core module housing, and a microwave cooking chamber, fitted in said core module housing; providing an intake module, comprising an intake module housing connectable to a lower side of the core module housing, and an air inlet for drawing air from an area above a range; and connecting said intake module to said lower side of the core module housing.

BRIEF DESCRIPTION OF THE DRAWINGS

The foregoing and further and more specific objects and advantages of the modular microwave oven and ventilation hood combination system will become readily apparent to those skilled in the art from the following description of embodiments thereof taken in conjunction with the drawings.

DESCRIPTION OF THE EMBODIMENTS OF THE INVENTION

Figure 1:
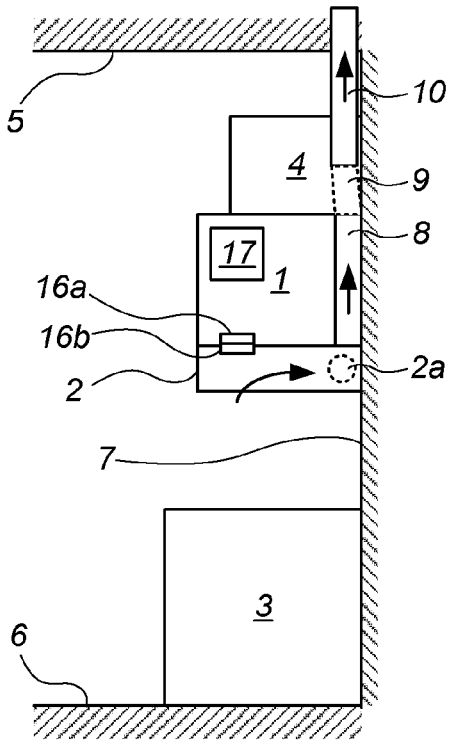
FIG. 1 is a schematic sectional view of an installed combination system according to a first embodiment of a first variant.

In the following description, similar elements will be designated by the same reference numerals. Arrows in FIGS. 1-12 indicate airflow.

In the following, some non-limiting examples of embodiments will be outlined, referring to the description of modules and optional features set forth above.

Referring to FIGS. 1-12, there is illustrated a respective range 3, positioned on a floor portion 6 adjacent a wall portion 7. A ceiling portion is indicated by reference numeral 5 and a kitchen cabinet is indicated by reference numeral 4. The kitchen cabinet may, where suitable, extend all the way up to the ceiling, or be spaced therefrom.

A core module 1 may comprise a chassis and/or a core module housing, a microwave cavity, cooking and electronic components, electronics ventilation, user interface and controls 17. Such user interface 17 may be arranged to control the functions of the core module 1, and optionally also the functions of one or more ventilation modules. The chosen ventilation module includes an intake module 2 and may also include an outlet module 14. As described herein, the outlet module 14 is optional. Where an outlet module 14 is present, it may comprise an outlet channel 9, 9', 9", 9'" or the combination of an outlet channel 9, 9', 9", 9'" with a fan unit 14*a*.

The core module may comprise a ventilation channel 8 extending from a lower side of the core module to an upper side of the core module. The ventilation channel 8 may be provided at a rear side of the core module 1, and may be aerodynamically clean and substantially straight. However, other positions of the ventilation channel 8 are not excluded.

The core module 1 may further comprise lower control connectors 16*a* for connection to an intake module 2 and/or upper control 16*c* connectors for connection to an outlet module 14.

Such control connectors 16*a*, 16*c* may be provided for allowing the functions of the intake module 2 and/or the outlet module 14 to be controlled from a user interface 17 on the core module 1. However, they may also be provided for allowing any one of the modules 1, 2, 14 to control the other modules. For example, the user interface 17 may be provided on the intake module 2, which may be the one best positioned for vertically challenged users.

The lower control connectors 16*a* may allow the fan 2*a* and/or lamps (not shown) of the intake module 2 to be controlled from a user interface 17 arranged on the core module 1.

The control connectors 16*a*, 16*c* may provide control signals or power to the intake module 2 and/or the outlet module 14.

The upper control connectors 16*c* may allow the fan unit 14*a* and/or enhanced air treatment/purification equipment 14*c* (see FIG. 14) to be controlled from a user interface 17 arranged on the core module 1.

The intake module 2 may comprise an intake module housing, which is separate from the core module housing. The intake module housing may comprise an air inflow section, the function of which is to form a transition between an inlet opening and an outlet opening, which is to connect to the ventilation channel 8 of the Core module 1.

Figure 15:
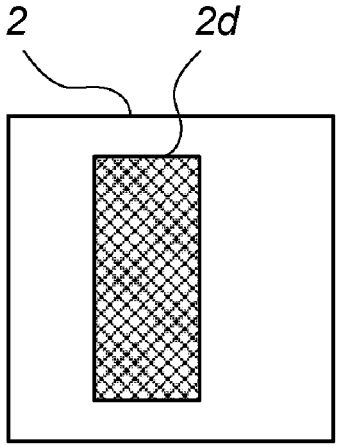
FIG. 15 is a schematic view from below of an intake module having a grease collector.

Optionally, depending on embodiment, the intake module 2 may comprise a fan 2*a*, 2*a*', a grease collection filter 2*d* (FIG. 15) and/or illumination, such as a lamp. The intake module 2 may comprise intake control connectors 16*b* for connection to the lower control connectors 16*a* of the core module 1.

Similarly, the outlet module 14 may comprise outlet control connectors 16*d* for connection to the upper control connectors 16*c* of the core module 1.

Furthermore, complimentary mechanical connectors may be provided for connection of the modules 1, 2, 14 to each other.

Embodiments of a combination system will now be described. Referring to FIG. 1, there is illustrated a combination system, comprising a core module 1, an intake module 2 which may comprise a fan unit 2*a*, and an outlet channel 9 in the form of an air transition module connecting the ventilation channel 8 to a vertical exhaust duct 10.

The outlet channel 9 may be entirely placed inside the kitchen cabinet 4 and provides a transition from the ventilation channel 8 of the core module 1 to a vertical (in-the-ceiling) exhaust duct.

The intake module 2 may comprise a grease collector 2d (FIG. 15), which is known in the art. The fan unit 2*a* may be a standard type fan unit, which is also known in the art.

Figure 2:
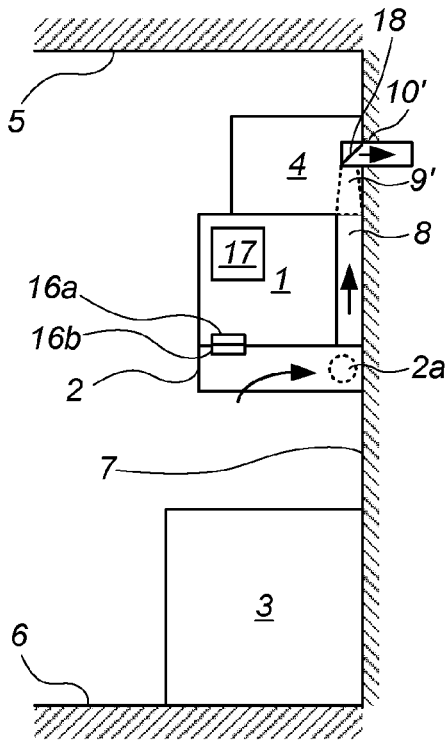
FIG. 2 is a schematic sectional view of an installed combination system according to a second embodiment of the first variant.

Referring to FIG. 2, there is illustrated a combination system, which is similar to the one described with reference to FIG. 1, but where the outlet channel 9' is in the form of an air transition module connecting the ventilation channel 8 to a horizontal exhaust duct 10'.

The outlet module 9' may be placed inside the kitchen cabinet 4 and provides a transition from the ventilation channel 8 of the core module 1 to a horizontal (in-the-wall) exhaust duct 10'. The exhaust duct 10' may contain an air deflector 18 for lowering airflow resistance.

Figure 3:
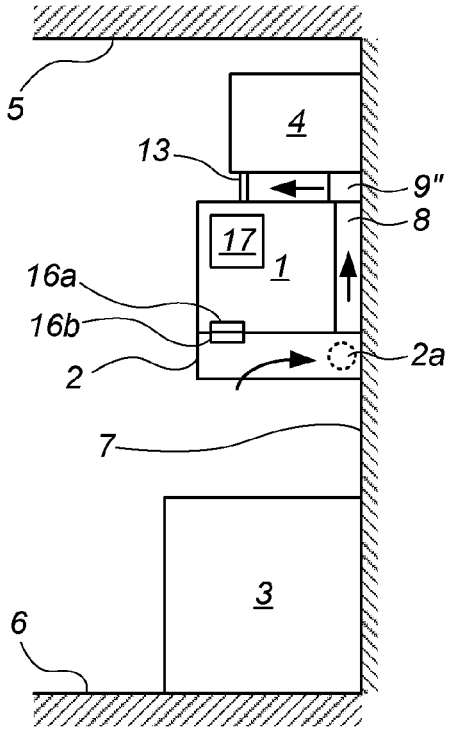
FIG. 3 is a schematic sectional view of an installed combination system according to a third embodiment of the first variant.

Referring to FIG. 3, there is illustrated a combination system, which is similar to the one described with reference to FIG. 1, and wherein the combination system is arranged to recirculate air through a gap between the upper side of the core module 1 and the lower side of the kitchen cabinet 4.

Optionally, an outlet channel 9" may be provided, having the form of an air deflector 18 as shown in FIG. 2, arranged to lower airflow resistance.

In this embodiment, spacers 13 may be provided between the core module 1 and the kitchen cabinet 4, so as to ensure a free airflow. A louvered grill may be provided at the front edge of the kitchen cabinet 4/core module 1, to improve appearance.

Figure 4:
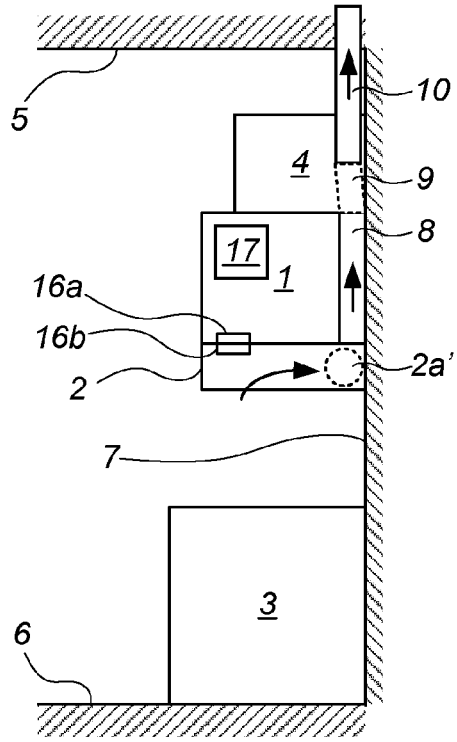
FIG. 4 is a schematic sectional view of an installed combination system according to a first embodiment of a second variant.

Referring to FIG. 4, there is illustrated a combination system, which is similar to the one described with reference to FIG. 1, but where the intake module 2 comprises a high CFM fan 2*a*'. By using a high CFM fan 2*a*', it is necessary to increase the height of the intake module by about 2.5 cm (1 inch). A "high CFM fan" is understood as a fan having about 50% higher capacity than existing products. For example, where 300 CFM is considered a standard capacity, a 450 CFM fan would be a "high CFM fan".

The outlet channel 9 may be entirely placed inside the kitchen cabinet 4 and provides a transition from the ventilation channel 8 of the core module 1 to a vertical (in-the-ceiling) exhaust duct 10.

Figure 5:
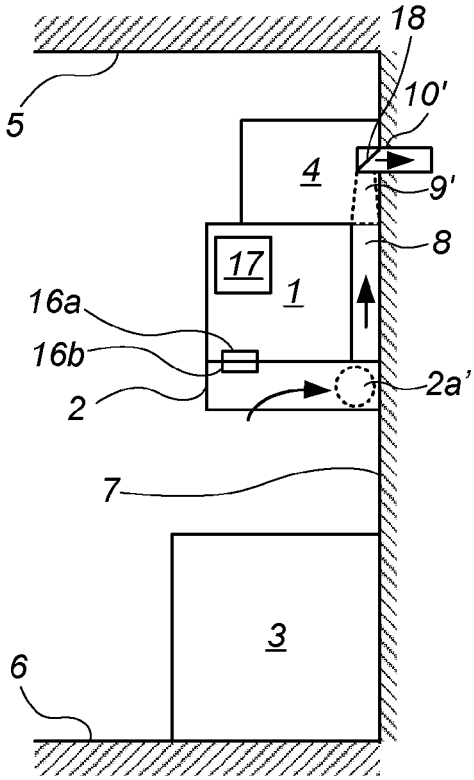
FIG. 5 is a schematic sectional view of an installed combination system according to a second embodiment of the second variant.

Referring to FIG. 5, there is illustrated a combination system, which is similar to the one described with reference to FIG. 4, but where the outlet channel 9' is in the form of an air transition module connecting the ventilation channel 8 to a horizontal exhaust duct 10'.

The outlet module 9' may be placed inside the kitchen cabinet 4 and provides a transition from the ventilation channel 8 of the core module 1 to a horizontal (in-the-wall) exhaust duct 10'. The horizontal exhaust duct 10' may contain an air deflector 18 for lowering airflow resistance.

Figure 6:
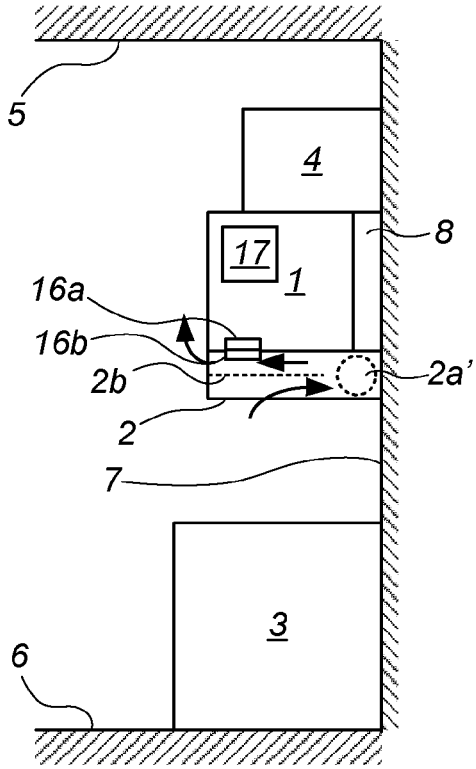
FIG. 6 is a schematic sectional view of an installed combination system according to a third embodiment of the second variant.

Referring to FIG. 6, there is illustrated a combination system, which is similar to the one described with reference to FIG. 4, but where the additional space provided by the high CFM fan 2*a*' is used to provide a recirculation channel inside the inlet module 2. The recirculation channel may be provided by arranging a baffle 2*b* to separate the air flowing into the fan 2*a*' from the air flowing out from the fan 2*a*'. In the embodiment of FIG. 6, the outlet from the recirculation channel is at the front side of the inlet module 2. Air louvers (not shown) may be provided to direct the outflowing air upwards or downwards.

In the combination system of FIG. 6, there is no need for an outlet module 14.

The core module 1 may or may not have a recirculation channel for returning airflow to the room. An example recirculation channel is shown in FIG. 6. If no recirculation channel is provided, the ventilation channel 8 may merely lead substantially straight from the lower side of the core module 1 to the upper side of the core module 1. By eliminating the recirculation channel and using a standard CFM fan 2*a*, it is possible to reduce the height of the intake module 2 by about 2.5 cm (1 inch).

Figure 13:
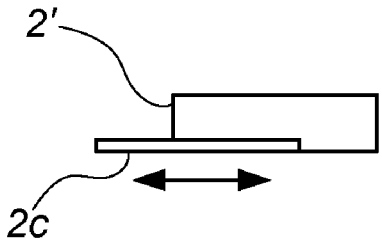
FIG. 13 is a schematic sectional view of an intake module having a slide-out hood.
Figure 14:
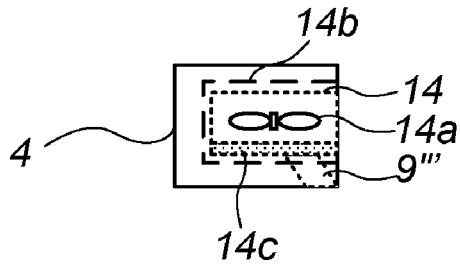
FIG. 14 is a schematic sectional view of an outlet module having additional features.

The reduction of height of the intake module 2 may further be used to provide a more slim design, or to include one or more additional features, such as a slide-out hood 2*c* (FIG. 13), a perimeter intake 2*e* (FIG. 16) or an enhanced air treatment purification device 14*c* (FIG. 14).

Figure 7:
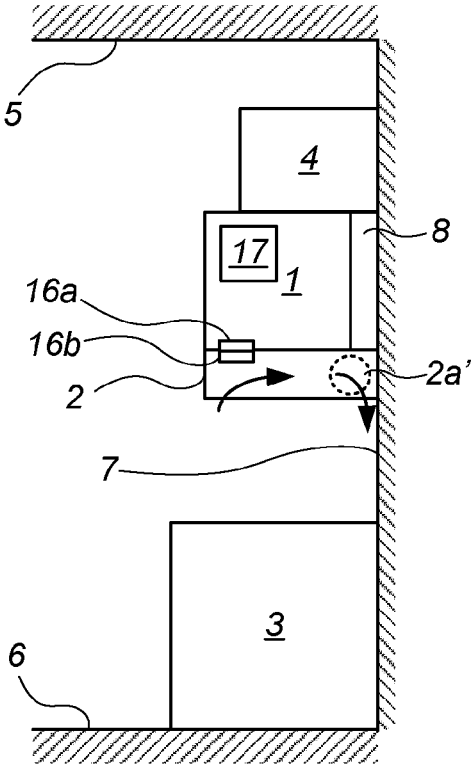
FIG. 7 is a schematic sectional view of an installed combination system according to a fourth embodiment of the second variant.

Referring to FIG. 7, there is illustrated a combination system, which is similar to the one described with reference to FIG. 6, but where the recirculation channel outputs the recirculated air at the back or bottom of the back of the inlet module 2. Angled air louvers (not shown) may be used to direct the air downwards, and/or to the sides of the range 3.

As with FIG. 6, the combination system of FIG. 7 does not require an outlet module 14.

Figure 8:
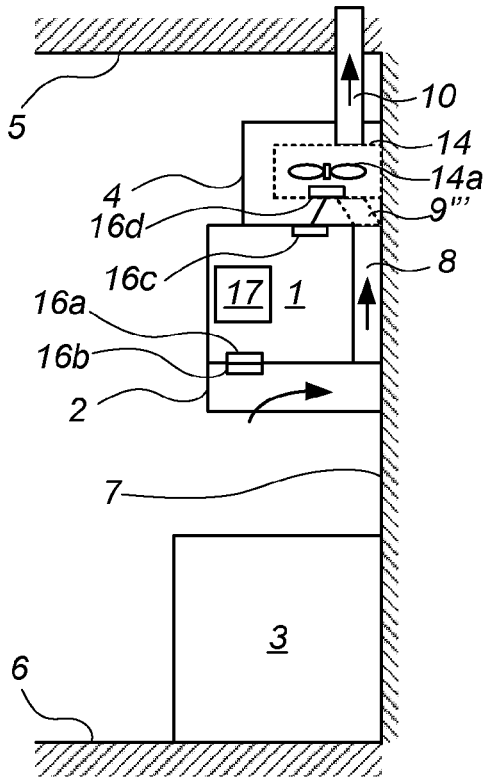
FIG. 8 is a schematic sectional view of an installed combination system according to a first embodiment of a third variant.

Referring to FIG. 8, there is illustrated a combination system, which is similar to the one described with reference to FIG. 1, but where the outlet channel 9''' is in the form of an air transition module connecting a fan unit 14*a* to the ventilation channel 8 of the core module 1. At an outlet side, the fan unit 14*a* may be connected to a vertical exhaust duct 10. The outlet module 14 may comprise a very high CFM fan 14*a* (due to the larger space available), and optionally additional sound insulation 14*b* (FIG. 14). A "very high CFM fan" is understood as a fan having about twice the capacity as compared with existing products. For example, where 300 CFM is considered a standard capacity, a 600 CFM fan would be a "very high CFM fan".

In this embodiment, as well as in FIGS. 9 through 12, there is no need for any fan unit in the intake module 2. Hence, the intake module 2 may provide a more slim design, or include one or more additional features, such as a slide-out hood 2*c* (FIG. 13), a perimeter intake 2*e* (FIG. 16) or an enhanced air treatment/purification device 14*c* (FIG. 14).

An enhanced air treatment/purification device 14*c* (FIG. 14) may also be installed in the outlet module 14.

Figure 9:
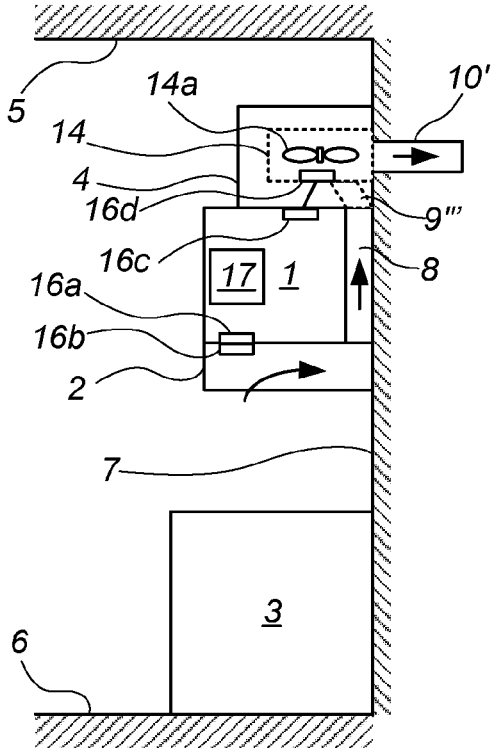
FIG. 9 is a schematic sectional view of an installed combination system according to a second embodiment of the third variant.

Referring to FIG. 9, there is illustrated a combination system, which is similar to the one described with reference to FIG. 8, but where the outlet module 14 is connected to a horizontal exhaust duct 10'.

Figure 10:
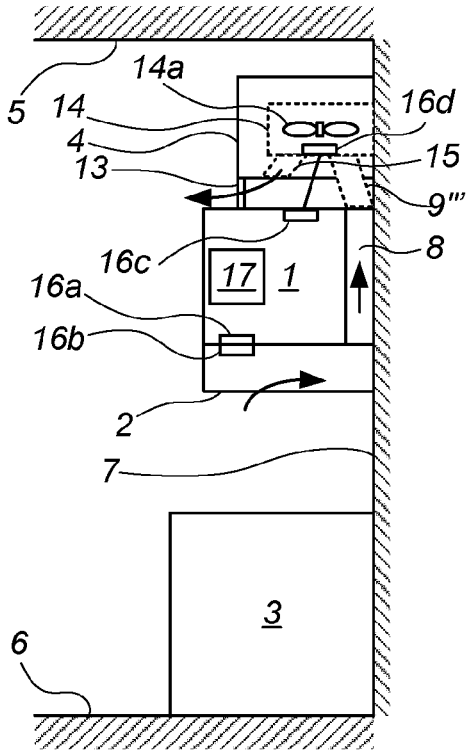
FIG. 10 is a schematic sectional view of an installed combination system according to a third embodiment of the third variant.

Referring to FIG. 10, there is illustrated a combination system, which is similar to the one described with reference to FIG. 8, but where recirculation is provided by a recirculation channel 15 from the outlet module 14 to a gap between the upper side of the core module 1 and the lower side of the kitchen cabinet 4. The outlet channel 15 may require a second hole to be made in the bottom of the kitchen cabinet 4.

In this embodiment, spacers 13 may be provided between the core module 1 and the kitchen cabinet 4, so as to ensure a free airflow. A louvered grill may be provided at the front edge of the kitchen cabinet 4/core module 1, to improve appearance.

Figure 11:
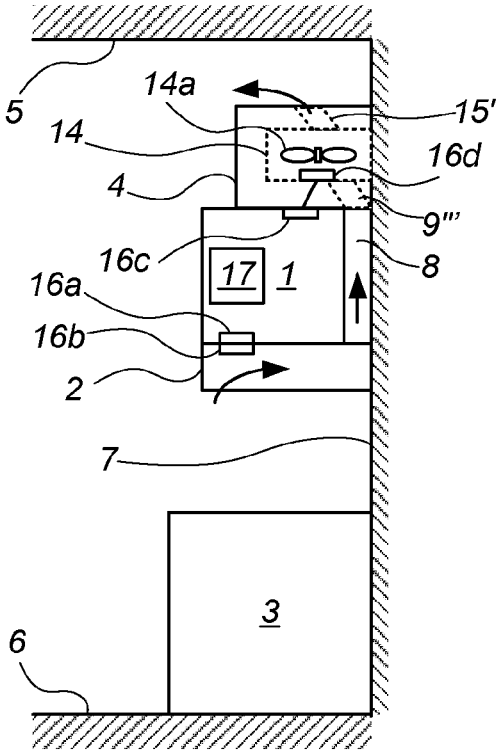
FIG. 11 is a schematic sectional view of an installed combination system according to a fourth embodiment of the third variant.

Referring to FIG. 11, there is illustrated a combination system, which is similar to the one described with reference to FIG. 8, but where recirculation is provided by a recirculation channel 15' from the outlet module 14 to the upper side of the kitchen cabinet 4. The recirculation channel 15' may require a second hole to be made in the top of the kitchen cabinet 4. This embodiment requires a space between the top of the kitchen cabinet 4 and the ceiling 5. Air deflectors (not shown) may be provided to ensure that the air is deflected to the front of the cabinet.

Figure 12:
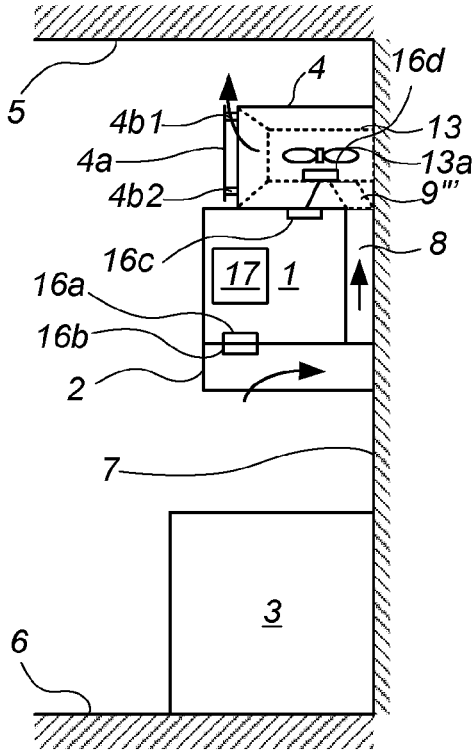
FIG. 12 is a schematic sectional view of an installed combination system according to a fifth embodiment of the third variant.

Referring to FIG. 12, there is illustrated a combination system, which is similar to the one described with reference to FIG. 8, but where recirculation is provided by an outlet inside the kitchen cabinet 4, e.g. through a diffuser (not shown). In this embodiment, it may be advantageous to provide spacers 4*b*1, 4*b*2 for the cabinet door 4*a*, so that air may flow out from the cabinet as indicated by the arrow in FIG. 12. The spacers could be in the form of spacing elements arranged to provide a gap at the cabinet door 4*a*, or in the form of door hinges that provide such a gap. Alternatively, the cabinet could be provided with one or more outlet openings for allowing air to flow out from the cabinet. This embodiment may render the cabinet 4 unusable for storage.

In FIG. 13, an intake module 2' having a slide-out hood 2*c* is schematically illustrated. Slide-out hoods are known in the art, but take up some vertical space as compared to a normal hood. Such space may be provided for by the reduction in height of the core module 1 and/or the intake module 2.

In FIG. 14, an outlet module 14 for mounting in a kitchen cabinet 4 is schematically illustrated. The fan unit 14 may comprise an enhanced air treatment and/or purification device 14*c* in the form of e.g. a carbon filter, a washable electronic filter, germicidal UV light and/or a disposable particle filter.

Such an enhanced air treatment and/or purification device may also be provided in the intake module 2, if the space permits. The fan unit 14 may also be provided with additional sound insulation 14*b*, and may be designed so as to counteract generation and/or propagation of mechanical vibrations.

Figure 16:
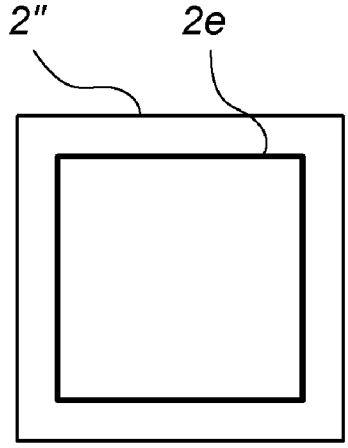
FIG. 16 is a schematic view from below of an intake module having a perimeter intake.

In FIG. 16, an intake module 2" having a perimeter intake 2*e* is schematically illustrated. Perimeter intakes are known in the art. The major benefit of a perimeter intake would be an improved capture capability of the intake module.

Based on the description above, it is noted that the described combination system comprises one core module 1 and a number of intake modules 2, which may have a normal fan 2*a* (FIGS. 1-3), a high CFM fan 2*a'* (FIGS. 4-7) or no fan at all (FIGS. 8-12). Furthermore, different intake modules may differ from each other by having e.g. a slide-out hood 2*c*, a perimeter intake 2*e*, or enhanced air treatment/purification 14*c*. The intake modules may also differ in terms of design, or in terms of other functions than the ones discussed above.

The system may comprise several different core modules, which differ in terms of design and/or functionality.

The system also comprises several different outlet modules, such as outlet channels 9, 9', 9", 9''' (FIGS. 1, 2, 4, 5), fan units 14*a* (FIGS. 8-12) and recirculation arrangements (FIG. 3).

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular microwave oven and ventilation hood combination system, comprising:

a core module, comprising:

a core module housing, and a microwave cooking chamber, fitted in said core module housing;

an intake module, comprising:

an intake module housing connected to a lower side of the core module housing, an air inlet for drawing air from an area above a range, and a user interface provided on one of the core module and the intake module, wherein said core module is provided with a first control connector and said intake module is provided with a second control connector, said first and second control connectors being interconnectable for individually controlling each of said intake module and said core module through said user interface.

2. The combination system as claimed in claim 1, wherein said core module comprises a ventilation channel, extending between a lower side of the core module housing and an upper side of the core module housing, and being adapted for conducting ventilation air from the lower side to the upper side.

3. The combination system as claimed in claim 2, wherein said ventilation channel is arranged not to allow air recirculation within said core module.

4. The combination system as claimed in claim 2, wherein said air inlet is connectable to the ventilation channel at the lower side of the core module housing.

5. The combination system as claimed in claim 1, wherein said core module comprises a user interface for controlling functions of said core module.

6. The combination system as claimed in claim 1, wherein said core module comprises a user interface for controlling functions of said intake module.

7. The combination system as claimed in claim 1, wherein said intake module comprises a grease collector, arranged to collect grease from air which is drawn into said intake module.

8. The combination system as claimed in claim 1, wherein said intake module comprises a fan system.

9. The combination system as claimed in claim 1, wherein said intake module comprises a slide-out hood.

10. The combination system as claimed in claim 1, wherein said intake module comprises a perimeter intake.

11. The combination system as claimed in claim 1, wherein said intake module comprises an air recirculation channel.

12. The combination system as claimed in claim 11, wherein said air recirculation channel opens at a recirculation outlet arranged at a front portion of said intake module.

13. The combination system as claimed in claim 11, wherein said air recirculation channel opens at an recirculation outlet arranged at a rear portion of said intake module.

14. The combination system as claimed in claim 13, wherein said recirculation outlet is directed downwardly.

15. The combination system as claimed in claim 1, further comprising an outlet module, which is connectable to a ventilation channel at an upper side of the core module housing.

16. The combination system as claimed in claim 15, wherein said outlet module is connectable to an exhaust duct and comprises a fan system for propelling air from said ventilation channel to said exhaust duct.

17. The combination system as claimed in claim 16, wherein said core module is provided with a third control connector and said outlet module is provided with a fourth control connector, said third and fourth control connectors being interconnectable for controlling at least one of said outlet module and said core module.

18. The combination system as claimed in claim 16, wherein the outlet module comprises an air recirculation channel.

19. The combination system as claimed in claim 18, wherein said air recirculation channel opens at a recirculation outlet arranged between said outlet module and the core module.

20. The combination system as claimed in claim 18, wherein said air recirculation channel opens at a recirculation outlet above said outlet module.

21. The combination system as claimed in claim 18, wherein said air recirculation channel opens at a recirculation outlet arranged to be disposed inside a cabinet.

22. A modular microwave oven and ventilation hood combination system, comprising:

a core module, comprising:

a core module housing, and a microwave cooking chamber, fitted in said core module housing;

an intake module, comprising:

an intake module housing connected to a lower side of the core module housing, and an air inlet for drawing air from an area above a range; and an outlet module, which is connectable to a ventilation channel at an upper side of the core module housing, wherein said outlet module comprises an air transition module, which is connectable to an exhaust duct to form a flow path from said ventilation channel to said exhaust duct.

23. The combination system as claimed in claim 22, wherein said air transition module comprises an air deflector.

24. The combination system as claimed in claim 22, further comprising spacers extending between the core module and the outlet module.

25. A method for providing a modular microwave oven and ventilation hood combination system, the method comprising steps of:

providing a core module, comprising:

a core module housing, and a microwave cooking chamber, fitted in said core module housing;

providing an intake module, comprising:

an intake module housing connectable to a lower side of the core module housing, and an air inlet for drawing air from an area above a range;

providing a user interface on one of the core module and the intake module; and connecting said intake module to said lower side of the core module housing, wherein said core module is provided with a first control connector and said intake module is provided with a second control connector, said first and second control connectors being interconnectable for individually controlling each of said intake module and said core module through said user interface.

* * * * *